US005213479A

United States Patent [19]

Dardis et al.

[11] Patent Number: 5,213,479

[45] Date of Patent: May 25, 1993

[54] LIQUID RING PUMPS WITH IMPROVED HOUSING SHAPES

[75] Inventors: Thomas R. Dardis, Stamford; Douglas E. Bissell, Bridgeport; Richard F. Gordon, Green Farms, all of Conn.

[73] Assignee: The Nash Engineering Company, Norwalk, Conn.

[21] Appl. No.: 865,448

[22] Filed: Apr. 9, 1992

[51] Int. Cl.[5] ..... F04C 19/00

[52] U.S. Cl. ..... 417/68; 417/69

[58] Field of Search ..... 417/68, 69

[56] References Cited

U.S. PATENT DOCUMENTS 2,368,528 1/1945 Edwards ..... 417/69

4,747,752 5/1988 Somarakis ..... 417/68

5,078,573 1/1992 Peroaho et al. ..... 417/69

FOREIGN PATENT DOCUMENTS 9119904 12/1991 World Int. Prop. O. ..... 417/68

*Primary Examiner*—Richard A. Bertsch

*Assistant Examiner*—Roland McAndrews

*Attorney, Agent, or Firm*—Robert R. Jackson

[57] ABSTRACT

In liquid ring gas pumps of the type having a rotor rotatably mounted in a stationary housing for forming a quantity of pumping liquid into a recirculating ring inside the housing, fluid friction loss between the liquid and the housing is reduced by shaping the surface of the housing which is in contact with the liquid ring radially outside the rotor so as to minimize or at least substantially reduce the area of that surface.

11 Claims, 7 Drawing Sheets

LIQUID RING PUMPS WITH IMPROVED HOUSING SHAPES

BACKGROUND OF THE INVENTION

This invention relates to liquid ring pumps, and more particularly to liquid ring pumps in which the inner surfaces of the housings are shaped to reduce fluid friction losses in the pumps.

Liquid ring pumps are well known as shown, for example, by Sommer U.S. Pat. No. 1,525,332 and Haavik U.S. Pat. No. 4,613,283. Russian inventor's certificate 529,295 points out that fluid friction in such pumps can be reduced by making the housing and turbine wheel of trapezoidal shape in axial section. According to this reference, by shaping the pump in this way the area of the housing surface contacted by the liquid is reduced, thereby reducing hydrodynamic loss in the pump.

The pump design shown in the above-mentioned Russian inventor's certificate results in several parts having very complex shapes. For example, the central housing element varies in axial length around the pump. As a consequence of this aspect of the shape of the central element, the faces of the end housing elements which abut the central element do not lie in planes perpendicular to the rotor axis. The pump of the Russian inventor's certificate would therefore be relatively difficult and expensive to make. In addition, while the trapezoidal shape shown in the Russian inventor's certificate may reduce hydrodynamic loss in the pump to some degree, there is a need for further reduction in such loss.

In view of the foregoing, it is an object of this invention to provide improved liquid ring pumps.

It is a more particular object of this invention to provide liquid ring pumps with reduced hydrodynamic loss due to contact between the recirculating liquid ring in the pump and the stationary housing of the pump.

SUMMARY OF THE INVENTION

These and other objects of the invention are accomplished in accordance with the principles of the invention by providing liquid ring pumps in which the inner surface of the housing is made up of axially extending arcs which are concave as viewed from the rotor radially outward, at least wherever the inner surface of the housing is spaced by any significant amount from the radially outer edges of the rotor blades. The inner surface of the housing is also preferably substantially free of any discontinuities in the circumferential direction around the pump. While other arcuate shapes (such as arcs of ellipses, ovals, etc.) can be employed in accordance with the invention, in the most preferred embodiments the arcs are circular because, of all geometric shapes, circles have the smallest ratio of circumference to area. Most preferably the inner surface of the housing in contact with the portion of the liquid ring w:ich is radially outside the rotor does not extend axially beyond the planes perpendicular to the rotor axis which include the axial ends of the radially outer edges of the rotor blades. Also most preferably each arc subtends an angle of no more than approximately 180°, and each arc extends to each of the above-mentioned planes perpendicular to the rotor axis. However, if the rotor is double-ended with a center shroud, the center shroud defines a third plane perpendicular to the rotor axis, and each arc may either extend without axial discontinuity through that plane, or the inner surface of the housing may have a cusp in the third plane.

Further features of the invention, its nature and various advantages will be more apparent from the accompanying drawings and the following detailed description of the preferred embodiments.

BRIEF DESCRIPTION OF THE DRAWINGS

FIG. 1 is taken along the line 1—1 in FIG. 2.

Figure 3:
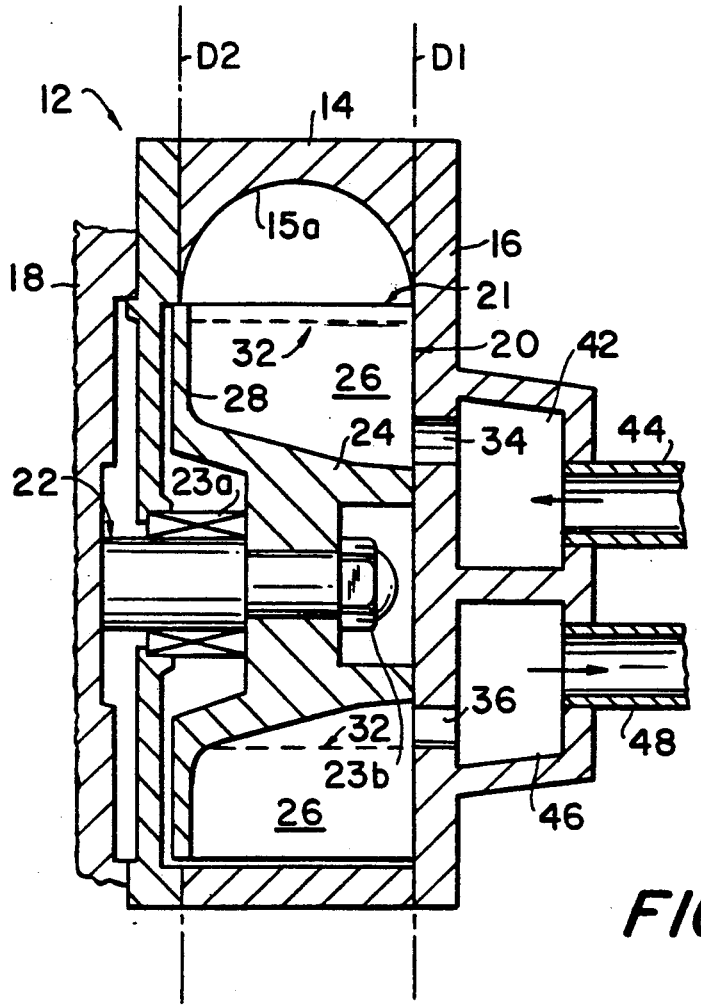
FIG. 3 is a view similar to FIG. 2 showing an illustrative embodiment of the present invention.

FIG. *7a* is a view similar to a portion of FIG. 3 showing another alternative embodiment of the invention.

FIG. *7b* is another view similar to a portion of FIG. 3 showing still another alternative embodiment of the invention.

Figure 2:
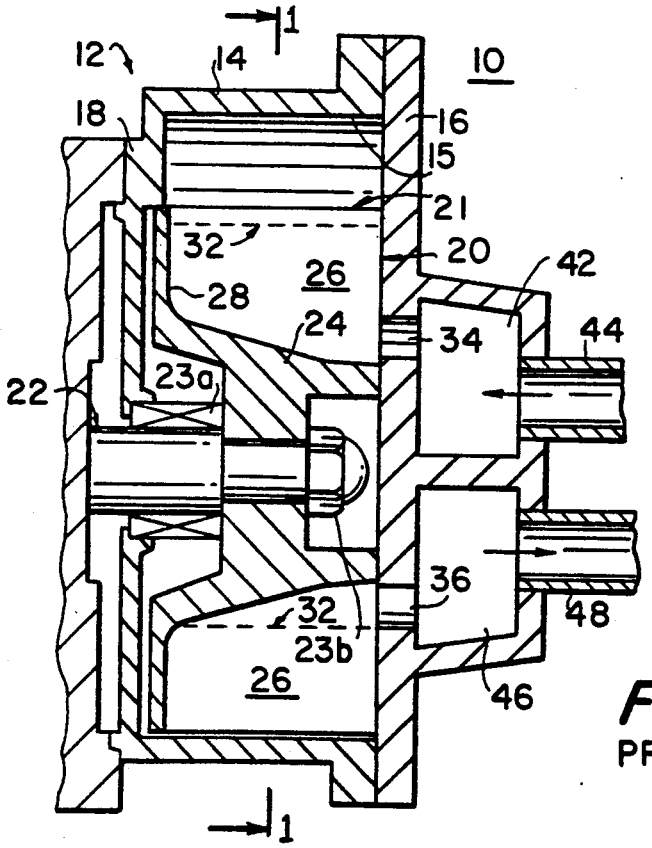
FIG. 2 PRIOR ART
FIG. 2 is a sectional view taken along the line 2—2 in FIG. 1.
Figure 8:
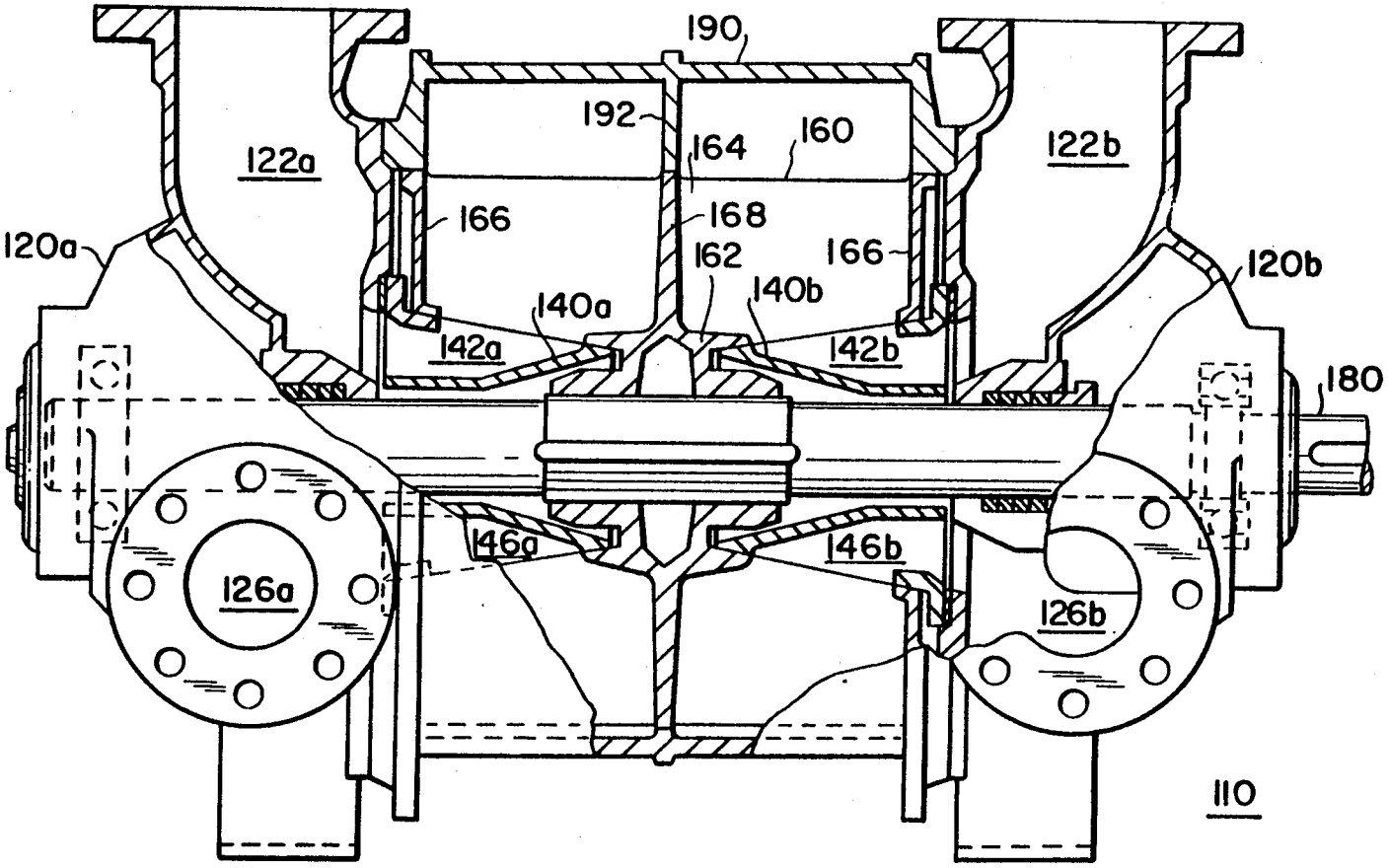
FIG. 8 PRIOR ART

FIG. 8 is a view similar to FIG. 2 showing another type of prior art liquid ring pump.

Figure 9:
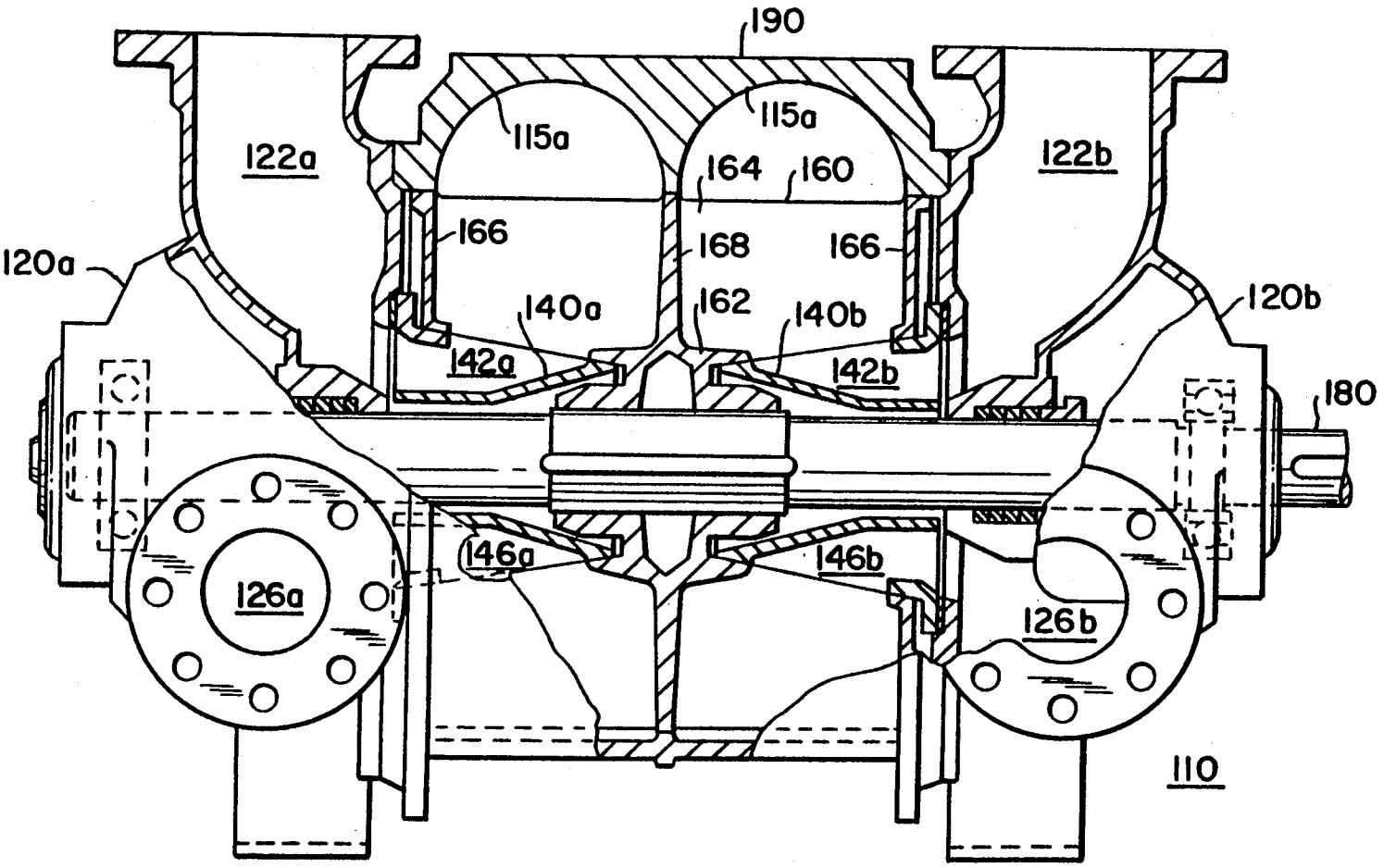

FIG. 9 is a view similar to FIG. 8 showing how the pump of FIG. 8 can be modified in accordance with the present invention.

Figure 10:
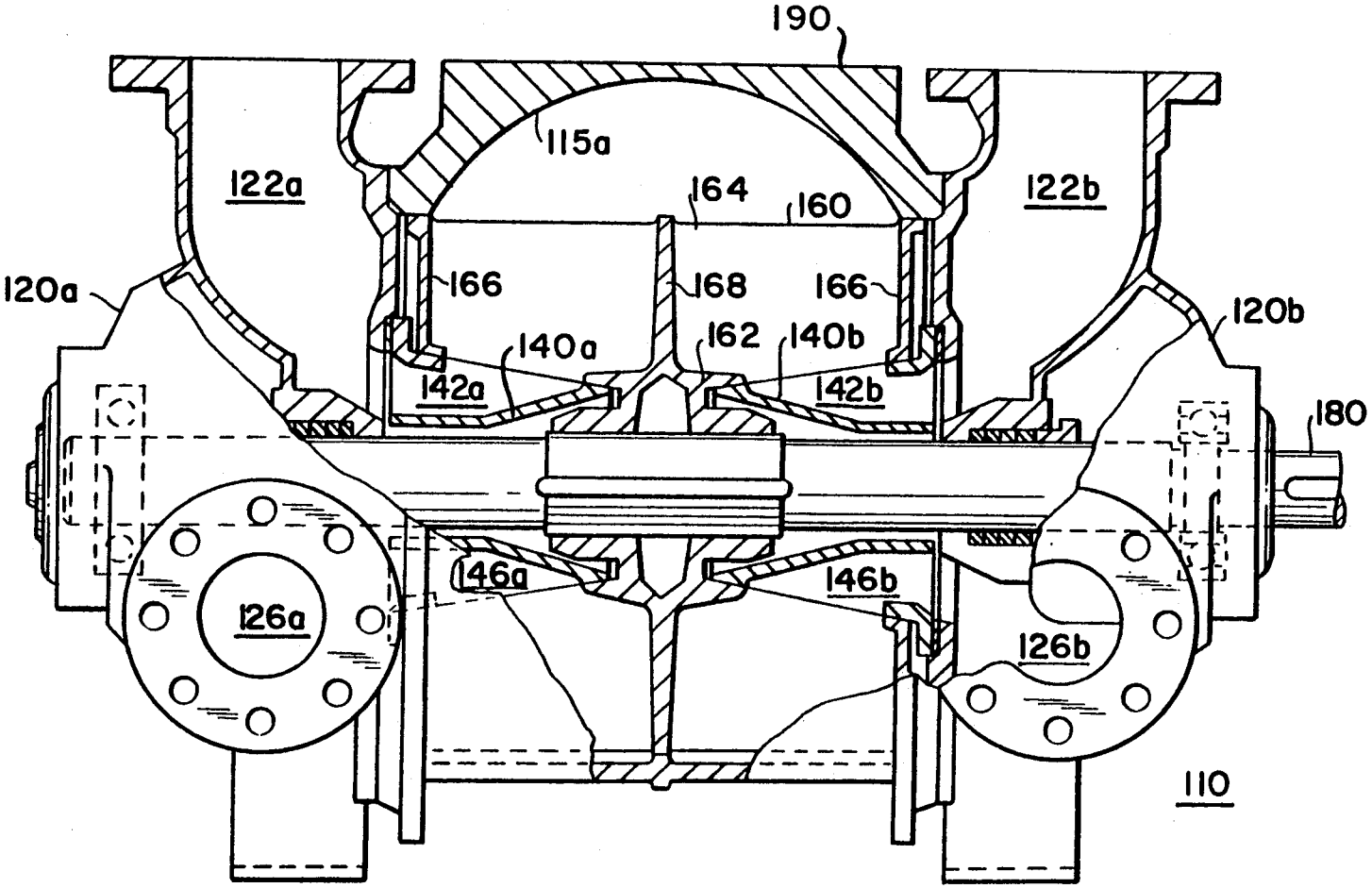

FIG. 10 is another view similar to FIG. 8 showing an alternative modification of the pump of FIG. 8 in accordance with this invention.

Figure 1:
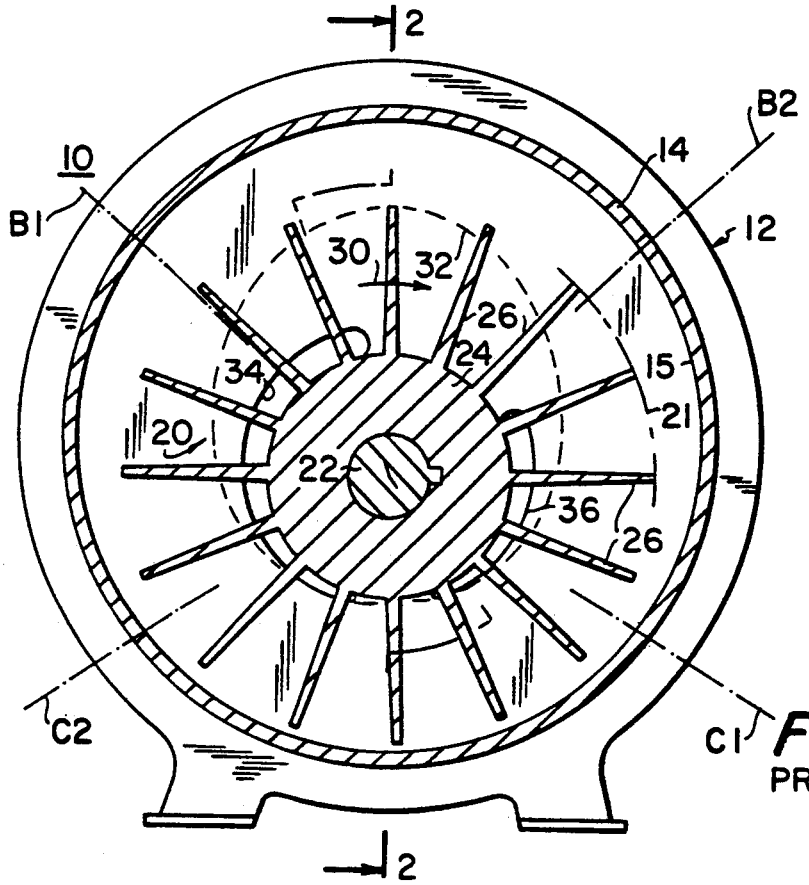
FIG. 1 PRIOR ART
FIG. 1 is a simplified cross sectional view of an illustrative conventional liquid ring pump.
Figure 11:
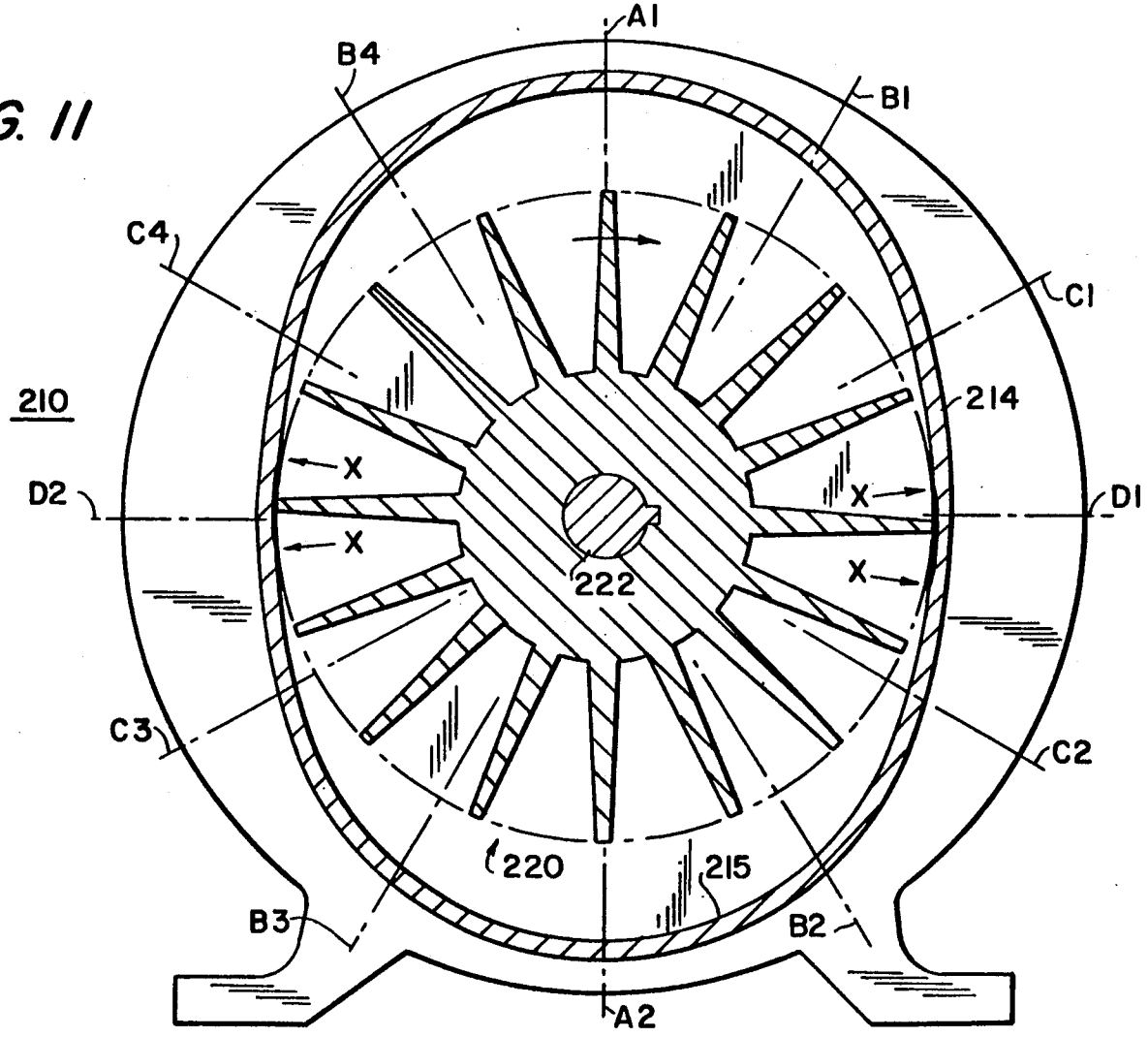

FIG. 11 is a view similar to FIG. 1 showing another type of liquid ring pump constructed in accordance with the principles of this invention.

DETAILED DESCRIPTION OF THE PREFERRED EMBODIMENT

Although the principles of this invention are equally applicable to liquid ring pumps having any number of intake and compression zones alternating in the circumferential direction around the pump, the invention will first be described in the context of pumps having only one intake zone and one compression zone in the circumferential direction. Similarly, although the invention is applicable to pumps having many different port configurations (e.g., ports through flat end plates or ports through frustoconical or cylindrical port members), the invention will be fully understood from the following discussion of pumps with two exemplary types of port structures. The invention is also applicable to any stage or stages of multistage pumps (i.e., pumps which discharge gas from one stage to the intake of another stage), but again the invention will be fully understood from the following explanation of its application to single-stage pumps.

As shown in FIGS. 1 and 2, illustrative prior art liquid ring pump 10 includes stationary housing 12 having annular peripheral wall 14 extending between parallel, spaced, front (or port) and rear plates 16 and 18, respectively. Rotor 20 is rotatably mounted in housing 12 by means of drive shaft 22 which extends through rear plate 18 to suitable drive means (not shown) such as an electric motor. Annular face seal 23*a* is provided between shaft 22 and rear plate 18.

Rotor 20 includes an annular hub 24 connected to drive shaft 22, a plurality of blades 26 extending radially outward from the hub in planes substantially parallel to the axis of drive shaft 22, and a disc-like rear shroud 28 also extending radially outward from the hub in a plane substantially perpendicular to the axis of drive shaft 22 so as to connect the rear portions of all of blades 26. Rotor 20 is held on 20 shaft 22 by rotor locking nut 23*b*. Rotor 20 is located eccentrically in housing 12 so that the outer periphery 21 of the rotor is much closer to the inner periphery 15 of annular housing wall 14 near the bottom of the pump than at the top of the pump. Although blades 26 are shown straight in FIGS. 1 and 2, blades 26 could alternatively be curved or hooked either forward or backward relative to the direction of rotor rotation in the manner known to those skilled in the art.

A quantity of pumping liquid is maintained in housing 12 so that when rotor 20 is rotated as indicated by the arrow 30 in FIG. 1, rotor blades 26 engage the pumping liquid and form it into a recirculating annular ring around the inner periphery 15 of annular housing wall 14. The approximate inner boundary or surface of this liquid ring is represented in FIGS. 1 and 2 by the dashed lines 32.

As best seen in FIG. 1, because rotor 20 is mounted eccentrically relative to housing wall 14, and hence is also eccentric to the liquid ring, rotor blades 26 extend much farther into the liquid ring near the bottom of the pump than they do near the top of the pump. On the left-hand side of the pump as viewed in FIG. 1, the inner surface 32 of the liquid ring gradually diverges from rotor hub 24 in the direction of rotor rotation. Accordingly, in that portion of the pump (known as the gas intake zone) the working spaces bounded by adjacent rotor blades 26, rotor hub 24, and the inner surface 32 of the liquid ring gradually increase in volume in the direction of rotor rotation. On the right-hand side of the pump as viewed in FIG. 1, the inner surface 32 of the liquid ring gradually converges toward rotor hub 24 in the direction of rotor rotation. Accordingly, in that portion of the pump (known as the gas compression zone) the working spaces bounded by adjacent rotor blades 26, rotor hub 24, and the inner surface 32 of the liquid ring gradually decrease in volume in the direction of rotor rotation.

Gas to be pumped is admitted to the intake zone of the pump via intake port 34 in front or port plate 16. The gas is supplied to the pump via intake conduit 44 and intake plenum 42. It is pulled into the pump by the expansion of the working spaces in the intake zone. This gas is subsequently compressed by the contraction of the working spaces in the compression zone. The compressed gas is then discharged from the pump via discharge port 36 in front or port plate 16. The compressed gas is conveyed from the pump via discharge plenum 46 and discharge conduit 48.

A source of energy loss, and therefore inefficiency, in liquid ring pumps is fluid friction between the recirculating liquid ring and the surface of the stationary housing 12 in contact with the liquid ring. Considering only the portion of the liquid ring which is radially beyond the radially outer edges of blades 26 in the illustrative pump of FIGS. 1 and 2, this portion of the liquid ring is typically in contact with a housing surface having the shape of a rectangle io which is open toward the center of the pump (see especially FIG. 2). This open rectangular shape has the largest perimeter at the top of the pump as viewed in FIG. 2, and the smallest perimeter at the bottom of the pump as viewed in that FIG. On the left side of the pump as viewed in FIG. 1, the perimeter of this rectangular shape gradually increases from the bottom to the top of the pump. On the right side of the pump as viewed in FIG. 1 the perimeter of this rectangular shape gradually decreases from the top to the bottom of the pump. Described another way, the portion of the liquid ring radially beyond the rotor in any plane which includes the rotor axis in FIGS. 1 and 2 typically occupies a rectangular shaped area in that plane. This rectangular shaped area is bounded by the radially outer edges of the rotor blades and the inner surfaces of housing members 14, 16, and 18. The size of this rectangular area is smallest at the bottom of FIG. 2, largest at the top of FIG. 2, increasing in size from the bottom to the top on the left of FIG. 1, and decreasing in size from the top to the bottom on the right in FIG. 1. The size of this rectangular area in any plane is dictated by the desired size of the adjacent working space in that plane.

The above-described rectangular-shaped areas are relatively inefficient in terms of ratio of area to perimeter. In other words, because these shapes are rectangular, they have a relatively high perimeter for a given area. This in turn means that for a given volume of liquid outside the rotor, a relatively large area of stationary housing surface is in contact with the liquid. Fluid friction loss is therefore relatively high.

In accordance with the present invention, the inner surface of the housing in contact with the liquid ring radially outside the rotor is reshaped so that in each of the above-mentioned planes inoluding the rotor axis the inner surface of the housing is arcuate rather than rectangular. This reduces the area of housing surface in contact with the liquid ring and therefore reduces fluid friction losses in the pump.

Figure 4:
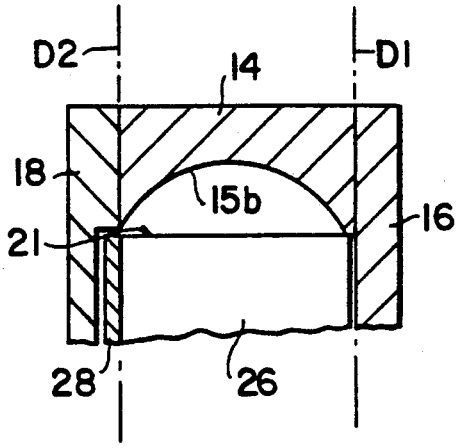
FIG. 4 is a view similar to a portion of FIG. 3 but taken at another angular location in the pump of FIG. 3 (i.e., at an angular location comparable to the one indicated by the line B1 or the line B2 in FIG. 1).
Figure 5:
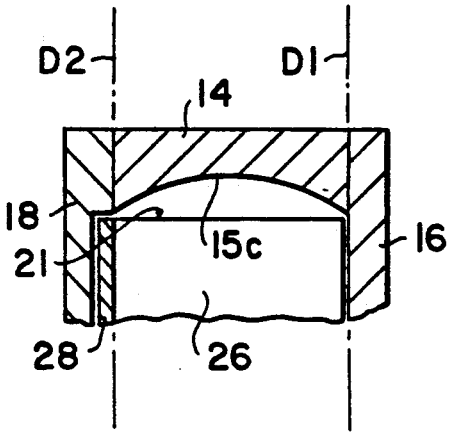
FIG. 5 is another view similar to a portion of FIG. 3 but taken at still another angular location in the pump of FIG. 3 (i.e., at an angular location comparable to the one indicated by the line C1 or the line C2 in FIG. 1).

FIGS. 3–5 show one way in which the pump of FIGS. 1 and 2 can be modified in this manner. Except at the extreme bottom of the pump where the inner surface of housing member 14 may remain axially straight and parallel to the rotor axis, in all other planes including the rotor axis the inner surface of housing member 14 is shaped as an axially extending circular arc (e.g., arc 15*a* at the top of FIG. 3, arc 15*b* in FIG. 4 which corresponds to the angular position of plane B1 or B2 in FIG. 1, and aro 15*c* in FIG. 5 which corresponds to the angular position of plane C1 or C2 in FIG. 1). All of these arcs are concave as viewed from rotor 20 outward. (Although in the particular embodiment shown in FIG. 3 the inner surface of housing member 14 is axially straight and parallel to the rotor axis at the bottom of the pump, in other embodiments even this portion of the housing inner surface may be slightly curved in the same general way as other portions of that surface.) Each arc preferably extends axially to but not beyond each axial end of the working portion of the rotor at the radially outer edges 21 of the rotor blades. Thus each arc extends axially to but not beyond each of planes D1 and D2 which are substantially perpendicular to the rotor axis and which include the axial ends of the outer edges 21 of the rotor blades. At each angular location around the pump the area in the plane which includes the rotor axis and which is bounded to, (1) the above-mentioned arc, (2) the adjacent outer rotor blade edges 21, and (3) (if necessary) planes D1 and D2 is preferably approximately equal to the area in the liquid ring outside the rotor at that same angular location in the comparable prior art pump (FIGS. 1 and 2). Thus the same amount of liquid can flow outside the rotor at each location around both the old and new pumps so the shape of the inner surface of the liquid ring is substantially unaltered by this invention. Equalizing the above-mentioned areas in comparable new and old pumps is therefore one way in which the radius of the arc at each location around the new pumps can be determined. Comparing FIGS. 3–5 it will be noted that a relatively small radius of curvature is used where a relatively large area is needed as at the top of FIG. 3. A larger radius of curvature is used as shown in FIG. 4 where a somewhat smaller area is needed, and a still larger radius of curvature is used as shown in FIG. 5 where a still smaller area is needed. In the limit, where the smallest area is needed at the bottom of FIG. 3, the radius of curvature may be thought of as extremely large or infinite.

Figure 6:
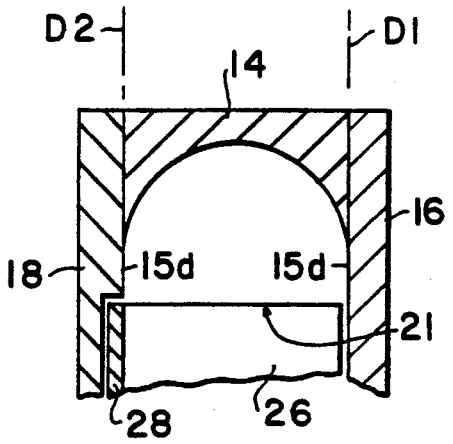
FIG. 6 is a view similar to a portion of FIG. 3 showing an alternative embodiment of the invention.

Just as the radius of curvature increases as the area bounded in part by the above-mentioned arcs decreases, so also the angle subtended by the arc decreases as the area decreases. However, to avoid a re-entrant or keyhole shape, the angle subtended by the arc is preferably no more than about 180°. If a larger area is needed than can be produced with an arc subtending 180°, then (as shown in FIG. 6) the 180° arc is preferably moved radially outward with tangents 15*d* in planes D1 and D2 back to the adjacent rotor blade edge.

Figure 7A:
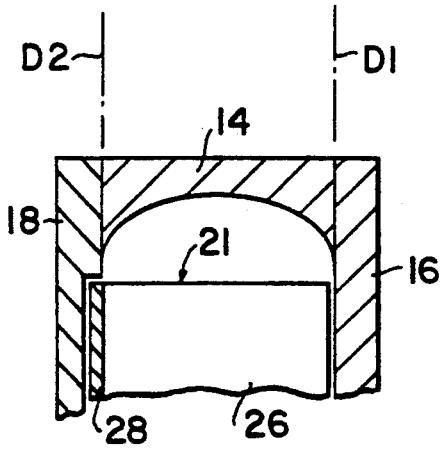
Figure 7B:
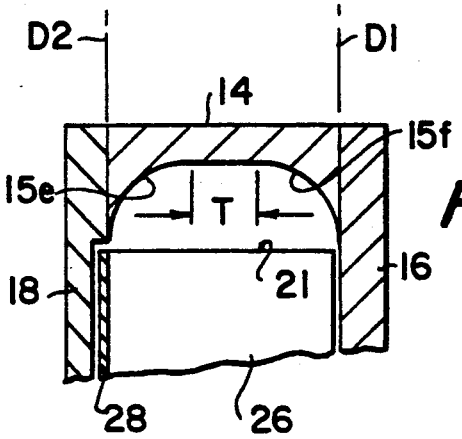

While the circular arcs shown in FIGS. 3–6 are most preferred because they have the smallest ratio of perimeter to bounded area, non-circular arcs (e.g., arcs of ellipses, ovals, etc., or multiple arcs joined by short, straight tangents) can also be employed in accordance with this invention. For example, FIG. 7*a* illustrates the use of elliptical arcs, the major axis of the ellipse being parallel to the rotor axis. FIG. 7*b* illustrates the use of circular arcuate segments 15*e* and 15*f* joined by a straight tangent T. Although tangent T is present in FIG. 7*b*, the surface is still very predominantly arcuate and is therefore accurately characterized as arcuate.

It is preferred in all cases that the inner surface 15 of the housing in contact with the liquid ring be substantially free of discontinuities in the circumferential direction around the pump. Thus inner surface 15 is preferably substantially smooth all the way around the pump (like surface 15 in FIG. 1 is smooth all the way around the pump) regardless of the axial location at which surface 15 is considered for this purpose. This means that the transitions from arc to arc circumferentially around the pump are gradual and substantially continuous or smooth. Although it is believed that circumferential smoothness of surface 15 is best, some slight surface discontinuities in the circumferential direction may be present in some embodiments (see, for example, the embodiment shown in FIG. 11 and discussed in detail below). If present, however, such discontinuities are preferably very small and not prominent enough to cause any significant disturbance in or perturbation of the flow of the adjacent pumping liquid.

FIG. 8 illustrates a typical prior art double-ended liquid ring pump 110 with frustoconical rather than flat port members. In pump 110 rotor 160 is mounted on shaft 180 for rotation inside stationary housing 190. Rotor 160 has a hub 162 and radially outwardly extending blades 164. The axial ends of blades 164 are interconnected by annular end shrouds 166. Blades 164 are also interconnected by annular central shroud 168. Rotor 160 has a frustoconical recess concentric with shaft 180 at each axial end. A hollow frustoconical port member 140*a*, 140*b* fits within each such recess. Each port member includes a gas intake conduit 142 and a compressed gas outlet conduit 146. These conduits in each of port members 140 communicate with other conduits in a respective one of 120 head members 120*a* and 120*b*. In particular, gas intake conduits 122 in head members 120 communicate with conduits 142 in port members 140, and gas outlet conduits 126 in head members 120 comm:nicate with conduits 146 in port members 140. Housing 190 is shown as including a radially extending, substantially annular shroud 192 which is radially aligned with the central shroud 168 on rotor 160. Shrouds 168 and/or 192 can be eliminated if desired.

Pump 110 operates very much like two pumps 10 back to back. The use of frustoconical port members in pump 110 helps allow each axial half of the pump to be made axially longer, thereby allowing increased capacity for a given pump diameter as compared to pumps with flat port members.

FIG. 9 shows one possible way of modifying pump li0 in accordance with this invention. In FIG. 9 the housing surface in oontaot with the portion of the liquid ring which is radially outside each axial half of rotor 160 is shaped using arcs (e.g., arcs 115*a*) in the same way that arcs are used in pump 10. Each arc extends axially from the associated end shroud 166 to central shroud 168 and is concave as viewed from rotor 160 outward. Each arc preferably subtends an angle of no more than about 180°. A cusp-like region is formed in the housing where the two arcs are joined. The area bounded by each arc and the adjacent rotor blade outer edge is preferably substantially equal to the area of the rectangular area bounded by that rotor blade edge and housing elements 190 and 192 in the comparable FIG. 8 pump at each angular location around the pump. In short, all of the principles discussed above in connection with FIGS. 17 apply again to each axial end portion of the FIG. 9 pump. Again, the preferred arcs are circular, but arcs of other shapes can be used instead if desired.

FIG. 10 shows an alternative embodiment of a pump of the type shown in FIG. 9. In FIG. 10 a single continuous arc 115*a* extends axially from one rotor end shroud 166 to the other such end shroud 166. The area bounded by this arc and the adjacent rotor blade outer edges is substantially equal to the area bounded by both arcs 115*a* and the same rotor blade edges in FIG. 9 at each angular location around the pump. Again, all of the same principles discussed above in connection with the other embodiments apply to the embodiment shown in FIG. 10.

All of the embodiments discussed above have one intake and one compression stroke per cycle of rotor revolution. It is well known, however, that liquid ring pumps can have more than one operating cycle per rotor revolution. For example, FIG. 11 shows a liquid ring pump 210 constructed in accordance with this invention having two intake zones and two compression zones alternating around the pump. Assuming clockwise rotation of rotor 220 inside housing 214, pump 2i0 has intake zones between planes D2 and A1 and between planes D1 and A2. pump 210 has compression zones between planes A1 and D1 and between planes A2 and D2. At planes D1 and D2 the inner surface 215 of housing 214 may be as shown at the bottom of the pump in FIG. 3 (i.e., axially straight and parallel to the axis of rotor shaft 222, or at least approximately as thus described). As one progresses from each of these planes into the succeeding intake zone, surface 215 gradually becomes increasingly axially arcuate as described above for the other embodiments. For example, at planes C4 and C2, inner surface 215 may be as shown for surface 15 in FIG. 5; at planes B4 and B2, inner surface 215 may be as shown for surface 15 in FIG. 4; and at planes A1 and A2, surface 215 may be as shown for surface 15 at the top of FIG. 3. Thereafter, surface 215 gradually becomes less axially arcuate. Thus at planes B1 and B3, inner surface 215 may again be as shown for surface 15 in FIG. 4; and at planes C1 and C3, surface 215 may again be as shown for surface 15 in FIG. 5. All of the principles discussed above in connection with the previous embodiments are again applicable to pump 210. The only difference is that instead of having one cycle of operation per rotor revolution, pump 210 has two identical cycles of operation per revolution.

Pump 210 illustrates the possibility that the inner surface 215 may have slight discontinuities in the circumferential direction. For example, slight circumferential surface discontinuities exist at points X in pump 210, although they are so slight, that they may be difficult to see in FIG. 11. Hence, even though slight discontinuities X are present in pump 210, surface 215 may still be accurately characterized as being substantially fre of discontinuities in the circumferential direction all the way around the pump. As mentioned above, these discontinuities are so small that they do not cause any significant disturbance in or perturbation of the adjacent pumping liquid flow.

It will be understood that the foregoing is merely illustrative of the principles of this invention, and that various modifications can be made by those skilled in the art without departing from the scope and spirit of the invention. For example, although all of the depicted embodiments are single-stage pumps, it will be readily apparent to those skilled in the art that the invention is equally applicable to any stage or stages of multistage pumps.

The invention claimed is:

1. In a liquid ring pump having a rotor rotatably mounted about a rotor axis in an annular housing for forming a quantity of liquid in the housing into a recirculating annular ring inside the annular inner surface of the housing such that the liquid ring moves radially outward from the rotor axis adjacent a gas intake zone of the pump and moves radially inward again adjcent a gas compression zone of the pump, said rotor having a plurality of circumferentially spaced, axially extending blades, the opposite axial ends of the radially outer edges of said blades lying in axially spaced first and second planes which are substantially perpendicular to said rotor axis, the improvement comprising:

said annular inner surface of said housing being formed so that the intersection between said annular inner surface and substantially any plane in which said rotor axis lies is an arc that is concave as viewed from said rotor axis outward, and which extends axially substantially the entire distance between but not substantially beyond said first and second planes, said annualr inner surface being substantially free of discontinuities in the circumferential direction all the way around said pump, the radially outer edge of each blade extending substantially the entire distance between axially spaced locations on said annular inner surface.

2. The pump defined in claim 1 wherein each said arc is substantially circular.

3. The pump defined in claim 1 wherein each said arc subtends an angle of no more than about 180°.

4. The pump defined in claim 1 wherein each said arc which subtends an angle of less than 180° is intercepted by each of said first and second planes immediately adjacent to the radially outer edges of said blades.

5. In a liquid ring pump having a rotor rotatably mounted about a rotor axis in an annular hosuing for forming a quantity of liquid in the housing into a recirculating annular ring inside the annular inner surface of the housing such that the liquid ring moves radially outward from the rotor axis adjacent a gas intake zone of the pump and moves radially inward again adjacent a gas compression zone of the pump, said rotor having a plurality of circumferentially spaced, axially extending blades, the opposite axial ends of the radially outer edges of said blades lying in axially spaced first and second planes which are substantially perpendicular to said rotor axis, the improvement comprising:

annular inner surface of said housing being formed so that the intersection between said annular inner surface and substantially any plane in which said rotor axis lies is a pair of axially adjacent, axially extending arcs joined at an intermediate cusp-like region, the end of each arc which is remote from said cusp-like region extending axially to but not substantially beyond a respective one of said first and second planes, the intermediate cusp-like regions of all of said pairs of arcs lying approximately in a third plane which is substantially perpendicular to said rotor axis, the radially outer edge of each blade extending substantially the entire distance between axially spaced locations on said annular inner surface.

6. The pump defined in claim 5 wherein said annular inner surface is substantially free of discontinuities in the circumferential direction all the way around said pump.

7. The pump defined in claim 5 wherein said rotor is axially partitioned by an annular shroud disposed in said third plane.

8. The pump defined in claim 5 wherein each said arc is concave as viewed from said rotor axis radially outward.

9. The pump defined in claim 5 wherein each said rac is substantially circular.

10. The pump defined in claim 5 wherein each said arc subtends an angle of no more than 180°.

11. The pump defined in claim 5 wherein each said arc which subtends an angle of less than 180° is intercepted by two of said first through third planes immediately adjacent to the radially outer edges of said blades.

* * * * *

UNITED STATES PATENT AND TRADEMARK OFFICE

CERTIFICATE OF CORRECTION

PATENT NO. : 5,213,479

DATED : May 25, 1993

INVENTOR(S) : Thomas R. Dardis, Douglas E. Bissell, and Richard F. Gordon

It is certified that error appears in the above-identified patent and that said Letters Patent is hereby corrected as shown below:

| Column | Line | |
|---|---|---|
| 1 | 58 | "w:ich" to --which--. |
| 3 | 12 | Delete "20" (second occurrence). |
| 4 | 2 | Delete "io". |
| 4 | 37 | Change "inoluding" to --including--. |
| 4 | 51 | Change "aro" to --arc--. |
| 4 | 68 | Change "to," to --by--. |
| 6 | 10 | After "of" delete "120". |
| 6 | 14 | Change "comm:nicate" to --communicate--. |
| 6 | 27 | Change "liO" to --110--. |
| 6 | 28 | Change "oontaot" to --contact--. |
| 6 | 43 | Change "17" to --1-7--. |
| 6 | 65 | Change "2iO" to --210--. |
| 7 | 31 | Change "fre" to --free--. |
| 8 | 3 | Change "annualr" to --annular--. |
| 8 | 30 | Before "annular" insert --the--. |
| 8 | 55 | Change "rac" to --arc--. |

Signed and Sealed this

Third Day of May, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,213,479

DATED : May 25, 1993

INVENTOR(S) : Thomas R. Dardis et al.

It is certified that error appears in the above-indentified patent and that said Letters Patent is hereby corrected as shown below:

Title page, item [56]: Add the following to the list of References Cited:

--U.S. PATENT DOCUMENTS

| | | | |
|---|---|---|---|
| 1,525,332 | 2/1925 | Sommer .... | 417/68 |
| 2,092,740 | 9/1937 | Bargeboer .... | 417/68 |

FOREIGN PATENT DOCUMENTS

| | | |
|---|---|---|
| 813,235 | 5/1937 | France .... |
| 3,313,446 | 10/1984 | Germany .... |
| 529,295 | 9/1976 | Russia .... |
| 257,507 | 10/1948 | Switzerland ....--. |

Signed and Sealed this

Thirteenth Day of June, 1995

*Attest:*

*Attesting Officer*

BRUCE LEHMAN

*Commissioner of Patents and Trademarks*